US005597413A

United States Patent [19]

Kromm, Jr.

[11] Patent Number: 5,597,413

[45] Date of Patent: Jan. 28, 1997

[54] DONOR BRUSH

[75] Inventor: Alvin D. Kromm, Jr., Webster, N.Y.

[73] Assignee: Xerox Corporation, Stamford, Conn.

[21] Appl. No.: 986,198

[22] Filed: Dec. 7, 1992

[51] Int. Cl.[6] ..... B05C 11/00; G03G 15/00

[52] U.S. Cl. ..... 118/60; 118/621; 349/325

[58] Field of Search ..... 427/444; 118/60, 118/264, 621; 355/284, 200, 259

[56] References Cited

U.S. PATENT DOCUMENTS

| | | | |
|---|---|---|---|
| 4,047,885 | 9/1977 | Hauman, Jr. | 432/60 |
| 4,150,181 | 4/1979 | Smith | 427/444 |
| 4,214,549 | 7/1980 | Moser | 118/60 |
| 4,219,327 | 8/1980 | Idstein | 355/290 X |
| 4,407,219 | 10/1983 | Dellevoet | 118/60 |
| 4,496,234 | 1/1985 | Schram | 355/3 FU |
| 4,593,992 | 6/1986 | Yoshinaza et al. | 355/3 FU |
| 4,659,621 | 4/1987 | Finn et al. | 118/60 X |

*Primary Examiner*—David A. Simmons
*Assistant Examiner*—M. Curtis Mayes

[57] ABSTRACT

A release agent management system including a metering roll supported for contact with release agent material contained in a sump. The metering roll also contacts a donor brush structure which, in turn, contacts a heated fuser roll member.

The ends of the brush structure are provided with a pair of friction devices which contact the surface of the heated fuser roll member and do not contact the metering roll. Thus, the donor brush structure and the heated fuser roll member are frictionally coupled so that positive rotation of the heated fuser roll member imparts rotation to the donor brush structure.

11 Claims, 3 Drawing Sheets

DONOR BRUSH

BACKGROUND OF THE INVENTION

The present invention relates to fuser apparatus for electrostatographic printing machines and in particular to release agent management (RAM) systems for a heat and pressure roll fuser.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Various systems have been used to deliver release agent fluid to the fuser roll including the use of oil soaked rolls and wicks with and without supply sumps as well as oil impregnated webs. A another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

Xerox Disclosure Journal (XDJ) Volume 7, Number 3 dated May/June 1982 discloses a release agent management system for a roll fuser apparatus. The apparatus comprises a fuser roll to which silicone oil is applied in order to counteract toner offset to the fuser roll. The fuser roll cooperates with a softer pressure roll to fuse toner images to a copy substrate such as plain paper. The silicone oil which is contained in a sump is applied to the surface of the fuser roll by means of a rotating brush which is adapted to be rotated in the opposite direction to that of the fuser roll. The brush engages one end of a wick while the other end of the wick is immersed in the silicone oil. Thus, the brush picks up silicone oil from the wick and conveys it to the fuser roll surface. Since the brush rotates counter to the fuser roll the brush bristles strip the lead edge of the copy and deflect it down and away from the fuser roll. The brush fibers undergo a snapping or flicking action as they move out of the nip formed between them and the fuser roll. It is this action which yields the stripping action. The oil application rate is controlled by the brush fiber density and the velocity of the fuser roll.

U.S. Pat. No. 4,593,992 issued on Jun. 10, 1986 discloses an image forming apparatus for forming an unfixed image on a recording material including a fixing device having a pair of rotatable members for holding therebetween and conveying the recording material to fix the unfixed image on the recording material, speed control device for variably controlling the fixing rotational speed of the pair of rotatable members to a first fixing speed and a second fixing speed lower than the first fixing speed, application apparatus for intermittently supplying a parting agent to at least one of the pair of rotatable members and application control apparatus for variably controlling the application acting period of the application apparatus in accordance with the fixing rotational speed of the pair of rotatable members variably set by the speed control device.

U.S. Pat. No. 4,496,234 issued on Jan. 29, 1985 discloses a release agent management (RAM) system for use with a heat and pressure fuser. The system is characterized by the use of a simple reciprocating, positive displacement pump for delivering silicone oil to the heated roll of the fuser. The pump is actuated in response to the fuser rolls being engaged and disengaged, such movement being adapted to act against one or the other of a pair of springs which in cooperation with the oil being pumped forms a damper system which is utilized to control the quantity of oil delivered. The springs and oil cause the velocity of the pump's piston to decay with time which results in more oil being pumped initially.

U.S. Pat. No. 4,047,885 issued on Sep. 13, 1977 discloses contact fuser assembly for use in an electrostatic reproducing apparatus including an internally heated metal core cooperating with a resilient backup roll to form a nip through which substrates carrying toner images are moved with the toner images contacting the metal core. The fuser assembly is characterized by the provision of a sump of liquid release agent material which is provided for coating the surface of the fuser roll structure. In order to apply the liquid release agent material to the surface of the fuser roll structure there is provided a cylindrical applicator member which is partially submersed in the release agent material. A ratchet wheel and pawl arrangement is provided for periodically indexing or moving the applicator member in response to disengagement of the backup roll from the fuser roll through pivoting of an arm supporting the backup roll. To this end, the pawl member is pivotally supported by the pivot arm and actuates the ratchet wheel each time the pivot arm is moved for effecting disengagement of the backup roll from the fuser roll.

Some of the RAM systems discussed above serve to dispense a fixed quantity of release agent material to a heated fuser roll member regardless of the desirability of dispensing different amounts of release agent material. Other systems such as the one disclosed in the XDJ noted above dispense more or less release agent material depending on the speed of the fuser roll contacted by the donor brush.

U.S. patent application Ser. No. 07/798,379 filed in the name of Fromm et al on Nov. 26, 1991, now U.S. Pat. No. 5,200,786, discloses a release agent management (RAM) system for a heat and pressure fuser. The RAM system includes a metering roll and donor brush or equivalent structure for providing a low friction nip between it and a pressure or fuser rolls and also between it and the metering roll. The low friction nip allows rolls contacting the donor brush or its equivalent to be operated at different speeds. Thus, the metering roll can be rotated at different speeds for delivering different quantities of release agent material in accordance with different operating conditions of the imaging apparatus in which the RAM system is used. As disclosed in this application the donor brush is either connected to a separate drive or operatively coupled to the pressure or fuser roll for rotation therewith.

Positive driving of machine components either by a dedicated drive arrangement or by some sort of mechanical coupling to other components add additional costs to one of the higher costing subsystems of xerographic printers and copiers. In addition to the added expense, such drive arrangements add complexity to the machine construction and servicing.

While the donor roll of the '549 patent can be frictionally driven via one of the fuser members such friction driving is not feasible in a donor brush RAM system due to the low friction between the donor brush and the fuser member which it contacts.

BRIEF SUMMARY OF THE INVENTION

Briefly, the present invention comprises a RAM system including a metering roll supported for contact with release agent material contained in a sump. The metering roll also contacts a donor brush structure which, in turn, contacts a heated fuser roll member.

The ends of the brush structure are provided with a pair of friction devices which contact the surface of the heated fuser roll member and do not contact the metering roll. To this end the donor brush structure is longer than the metering roll and shorter than the heated fuser roll member. Thus, the donor brush structure and the heated fuser roll member are frictionally coupled so that positive rotation of the heated fuser roll member imparts rotation to the donor brush structure.

DETAILED DESCRIPTION OF THE PREFERRED EMBODIMENT OF THE INVENTION

Figure 3:
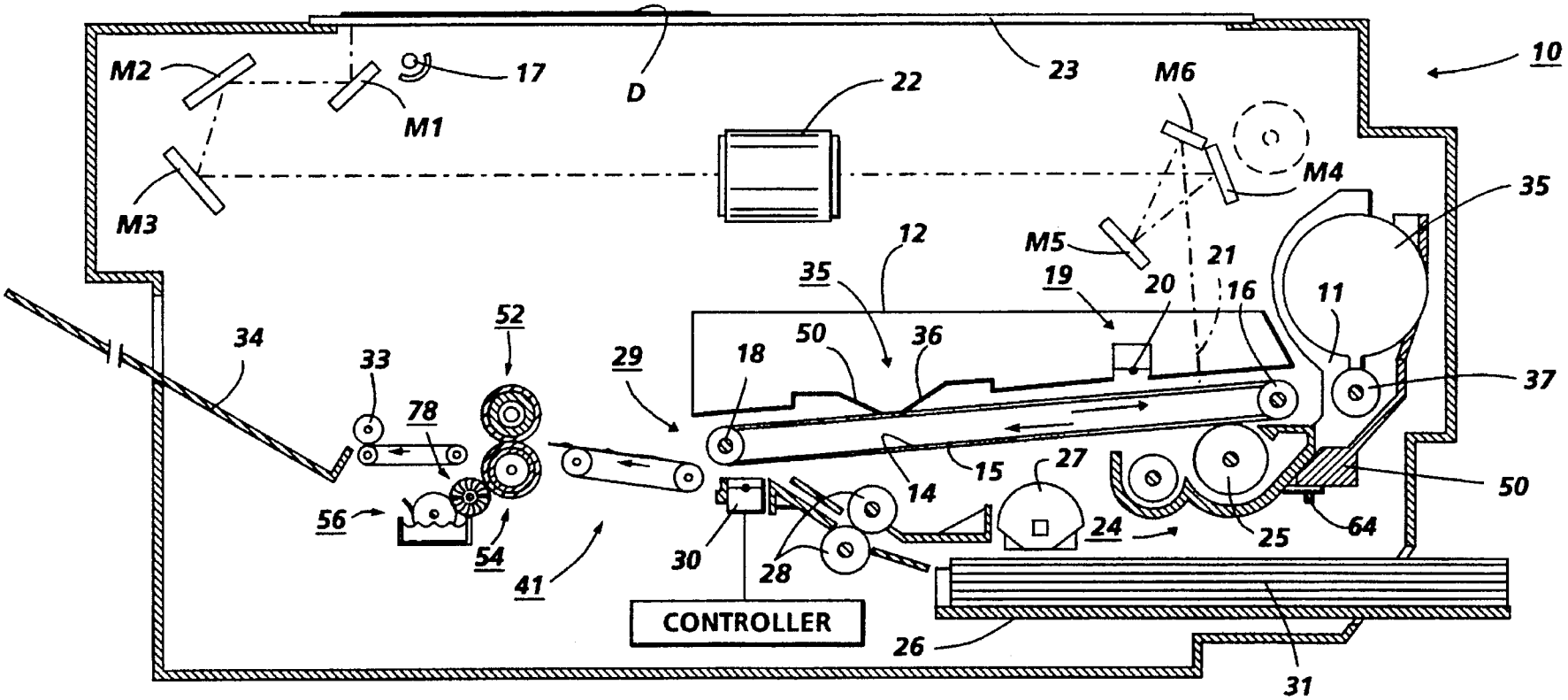
FIG. 3 is a schematic illustration of a copying machine incorporating the invention.

Referring now to FIG. 3, there is shown by way of example, an automatic electrostatographic reproducing machine 10 which includes a removable processing cartridge 12. The reproducing machine depicted in FIG. 3 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 3 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fixing station 41 comprising heated fuser roll 52 and pressure roll 54 forming a nip therebetween wherein roll fuser 52 fixes the transferred powder image thereto.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scrapping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 2:
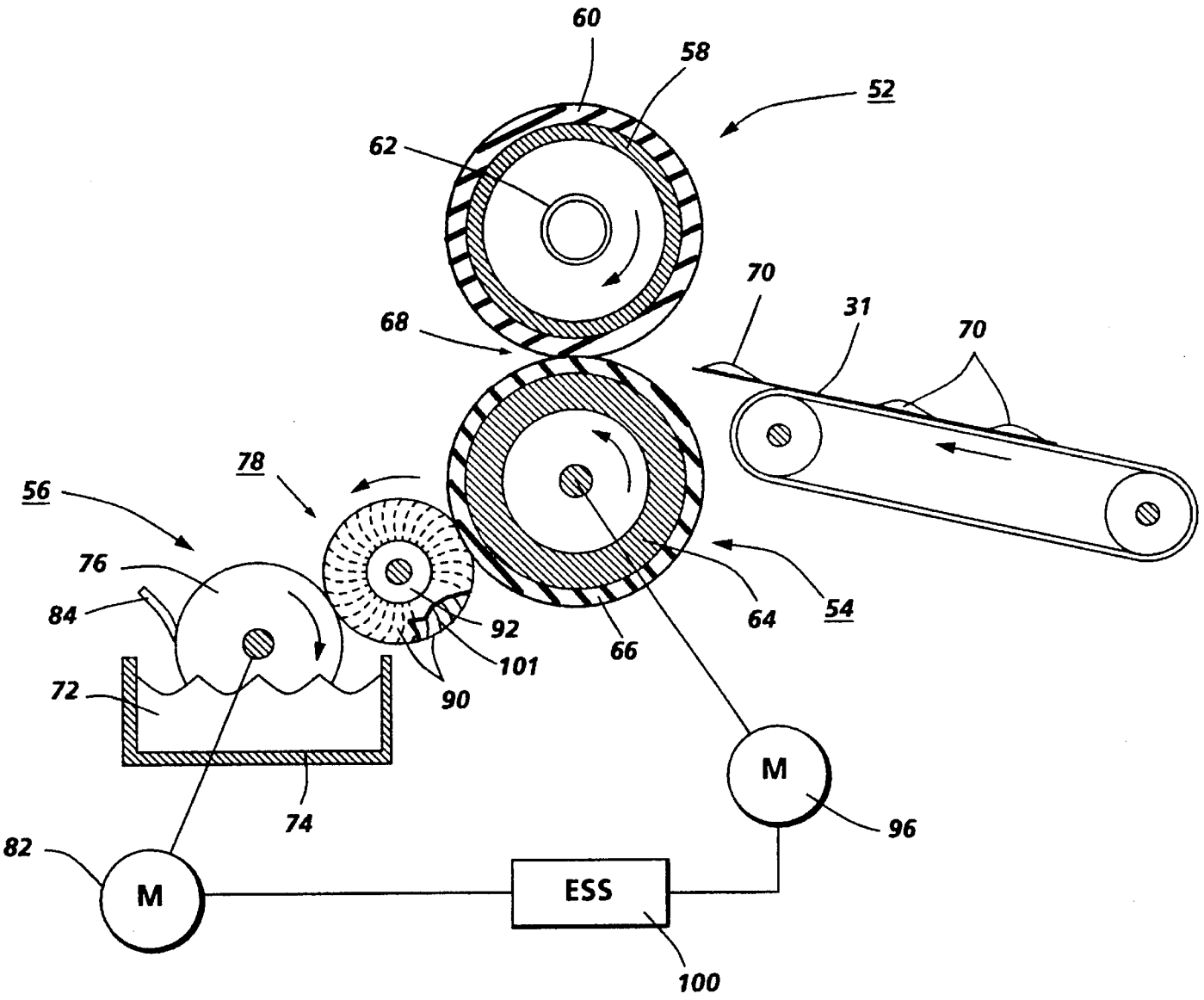
FIG. 2 is a schematic representation of a roll fuser and a release agent management (RAM) system representing one embodiment of the invention.

Attention is now directed to FIG. 2 wherein the heat and pressure fuser apparatus comprising the fuser roll 52 and pressure roll 54 are illustrated together with a release agent management (RAM) system 56. As shown in FIG. 2, the fuser apparatus comprises the heated fuser roll 52 which is composed of a core 58 having coated thereon a thin layer 60 of an elastomer. The core 58 may be made of various metals such as iron, aluminum, nickel, stainless steel, etc., and various synthetic resins. Aluminum is preferred as the material for the core 58, although this is not critical. The core 58 is hollow and a heating element 62 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials such as the RTV and HTV silicone elastomers as well as Viton (trademark of E.I. du Pont de Nemours & Co.).

The fuser roll 52 is shown in a pressure contact arrangement with the backup or pressure roll 54. The pressure roll 54 comprises a metal core 64 with a layer 66 of a heat-resistant material. In this assembly, both the fuser roll 52 and the pressure roll 54 are mounted on bearings (not shown) which are biased so that the fuser roll 52 and pressure roll 54 are pressed against each other under sufficient pressure to form a nip 68. It is in this nip that the fusing or fixing action takes place. The layer 66 may be made of any of the well known materials such as fluorinated ethylene propylene copolymer or silicone rubber.

The image receiving member or final support 31 having toner images 70 thereon is moved through the nip 68 with the toner images contacting the heated fuser roll 52. The toner material forming the image 70 is prevented from offsetting to the surface of the fuser roll 52 by the application of a release agent material such as silicone oil 72 contained in sump 74.

The sump 74 and silicone oil 72 form part of the RAM system 56. The RAM system 56, according to one embodiment of the invention, further comprises a metering roll 76 and a donor brush 78. The metering roll is supported partially immersed in the silicone oil 72 and contacts the donor brush for conveying silicone oil from the sump to the bristles of the donor brush 78. The donor brush is rotatably supported for contact with the metering roll and also in contact with the pressure roll 54. While the donor brush is illustrated as contacting the pressure roll, it will be appreciated that, alternately, it may contact the fuser roll 52. Also, the positions of the fuser and pressure rolls may be reversed for use in other copiers or printers. A metering blade 84 supported in contact with the metering roll 76 serves to meter silicone oil to the required thickness on the metering roll.

Whereas the contact of the donor roll of the '549 patent with its associated metering roll and the roll to which it delivers silicone oil is intimate (i.e. a high percentage of contact) the contact of the donor brush 78 with the pressure roll 54 and the metering roll 76 is only about 10%. The low percentage of contact between the donor brush and the other rollers provides for low torque transmission form the donor brush to the metering and fuser rolls. In operation, the donor brush tends to slide relative to the metering and pressure rolls and the area of contact therebetween is very low, approximately 10%.

A pair of wheels 90 attached to the core 92 of the donor brush structure 78 engage the surface of the pressure roll 54. The wheels may be attached to the core in any suitable manner such as by pressing, by molding or gluing them thereto. The wheels are may be fabricated from any material such as rubber, plastic or metal which provides a high coefficient of friction between it and the pressure roll surface. The high coefficient of friction provides friction driving of the donor brush by the pressure which is positively driven via a motor 96 and suitable drive train, not shown.

Thus, the donor brush comprises first and second members, bristles 101 and friction wheels 90, respectively, both of which contact the pressure roll 54. The bristles contact the pressure roll with low friction while the friction wheels engagement it with a relatively high friction.

Figure 1:
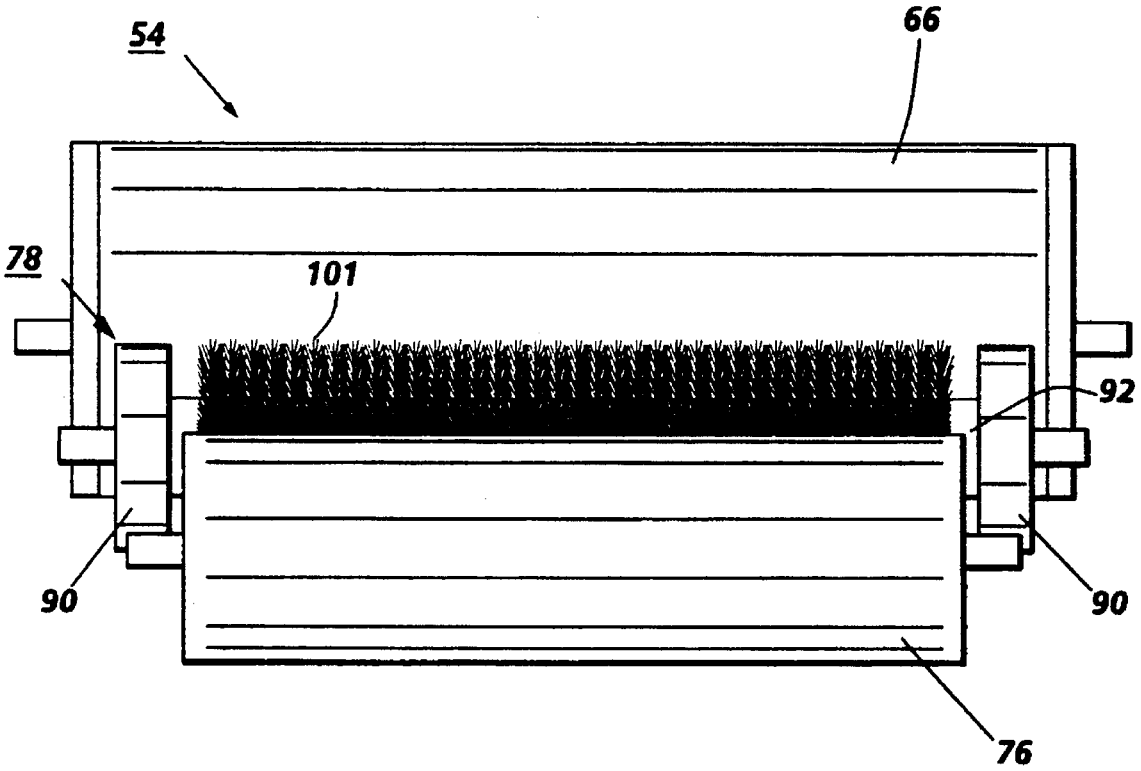
FIG. 1 is a schematic front illustration of a heated fuser roll, donor brush and metering roll representing the present invention.

As illustrated in FIG. 1, the donor brush structure 78 is longer than the metering roll structure 76 and shorter than the pressure roll 54. Such an arrangement permits contact of the friction wheels with the pressure roll while precluding contact between them and the metering roll thereby permitting driving of the donor brush by the pressure roll without engagement between the friction wheels and the metering roll.

The metering roll is a smooth-surfaced metal roll on which the oil picked up from the sump is metered to the desired thickness by a metering blade 84. The metering roll is adapted to be driven at different speeds to deliver different oil quantities of oil. To this end the motor 82 designed to rotate the metering roll in the order of 5 to 100 RPM which is about 1 to 20% of the rotational speed of the pressure roll 54. The metering roll has a diameter of 20–75 mm and the donor brush has a diameter in the order of 20–40 mm.

The bristle member 100 of the donor brush 78 is fabricated using heat-resistant fibers made of, by way of example, the copolymer of metaphenylenediamine and isophthaloyl chloride. A loading pressure of 0.5 to 10 PSI causes the donor brush to conform to the surfaces of the pressure and metering rolls. At the aforementioned operating speeds of the metering roll, the brush fibers serve to deliver in the order of 1 to 6 μl of silicone oil.

The speed of the metering roll is controlled by the motor 82 (FIG. 2) which is, in turn, controlled by the Electronic Subsystem (ESS) 100. The ESS comprises the necessary electronics and logic circuitry, well know in the art, to process control signals for controlling the rotational speeds of the motors 82 and 96. The speed of the metering roll causes the metering roll to deliver somewhere between 1 to 6 μl of silicone oil to the donor brush in accordance with an algorithm forming a part of the ESS.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. Apparatus for applying offset preventing liquid to the surface of one member of a contact fuser for fixing powder images to a substrate, said apparatus comprising:

a supply of release agent material;

a release agent metering member supported for contact with said supply of release agent material;

means for effecting movement of said metering member in an endless path;

donor structure having first and second members thereof contacting said surface of said one member of a contact fuser, one of said members exhibiting a low coefficient of friction between it and said surface of said fuser member and another of said members exhibiting a high coefficient of friction between it and said surface of said fuser member; and means for positively driving said fuser member such that simultaneous movement of said donor structure via said another of said members is effected.

2. Apparatus according to claim 1 wherein said one of said members of said donor structure contacts said metering member.

3. Apparatus according to claim 1 wherein said one of said members of said donor structure comprises a brush.

4. Apparatus according to claim 3 wherein said another of said members of said donor structure comprises a pair of friction wheels carried by said donor structure adjacent the outer ends thereof such that said brush is disposed intermediate thereof.

5. Apparatus according to claim 4 wherein the relative lengths of said donor structure, fuser member and said metering member are such that said brush contacts both said metering member and said fuser member.

6. Apparatus according to claim 5 wherein said friction wheels do not contact said metering member.

7. Apparatus according to claim 6 wherein said metering member comprises a roll structure.

8. Apparatus according to claim 7 including means for heating said fuser member.

9. A release agent management donor member for use in applying release agent material to a fuser member, said member comprising:

first and second members for contacting the surface of said fuser member, one of said members exhibiting a low coefficient of friction between it and said surface of said fuser member and another member exhibiting a high coefficient of friction between it and said surface of said fuser member.

10. A member according to claim 9 wherein said one of said members comprises a brush structure.

11. A member according to claim 10 wherein said another member comprises a pair of friction wheels.

* * * * *